US007266858B2

(12) United States Patent
Cronin et al.

(10) Patent No.: US 7,266,858 B2
(45) Date of Patent: Sep. 11, 2007

(54) THREE IN ONE PAINTBRUSH CLEANER AND CONDITIONER

(75) Inventors: Raymond M. Cronin, New Port Richey, FL (US); Steve Athanassie, New Port Richey, FL (US)

(73) Assignee: Sarmic Enterprises, LLC, New Port Richey, FL (US)

( * ) Notice: Subject to any disclaimer, the term of this patent is extended or adjusted under 35 U.S.C. 154(b) by 22 days.

(21) Appl. No.: 11/306,318

(22) Filed: Dec. 22, 2005

(65) Prior Publication Data

US 2007/0143940 A1 Jun. 28, 2007

(51) Int. Cl.
*A46B 17/06* (2006.01)

(52) U.S. Cl. ..... 15/105; 15/111; 15/142; D4/117; D4/118

(58) Field of Classification Search ..... 15/104.5, 15/105, 111, 142; 119/611, 612; 132/120; D4/116–118
See application file for complete search history.

(56) References Cited

U.S. PATENT DOCUMENTS 119,659 A * 10/1871 Smith ..... 119/612
248,817 A * 10/1881 Weaver et al. ..... 119/612
250,349 A * 12/1881 Dole ..... 119/612
289,550 A * 12/1883 Miles, Jr. ..... 15/104.5
792,013 A * 6/1905 Flemming ..... 132/120
2,238,603 A * 4/1941 Runnels ..... 132/120
4,286,349 A * 9/1981 Dugrenier ..... 15/111

* cited by examiner

*Primary Examiner*—Mark Spisich
(74) *Attorney, Agent, or Firm*—Ronald E. Smith; Smith & Hopen, P.A.

(57) ABSTRACT

A combination tool for cleaning the bristles of a paintbrush includes a plurality of wire strands arrayed on said base in rows and columns, at least one blunt-edged scraper blade arrayed on said base in transversely disposed relation to a longitudinal axis of the tool, and a plurality of comb teeth arrayed on said base between the handle and the wire strands and the at least one scraper blade. The tool performs three functions at one time so that the amount of time required to clean the bristles is one-third the time required to use all three tools separately. The tool increases productivity and reduces the number of paintbrushes that must be purchased in a given time period.

6 Claims, 2 Drawing Sheets

THREE IN ONE PAINTBRUSH CLEANER AND CONDITIONER

FIELD OF THE INVENTION

This invention relates, generally, to combination tools. More particularly, it relates to a tool that combines wire strands, a scraper and comb teeth for cleaning and conditioning paintbrushes.

DESCRIPTION OF THE PRIOR ART

As the science of chemistry has advanced, paint manufacturers have applied such technology to reduce the drying time of paint. Paintbrushes therefore become caked with dried paint quite rapidly. Modern paints dry so quickly that many painters have discovered they need to clean their brushes not just after a job, but even during a job.

Cleaning a paintbrush properly requires the use of three tools, all of which are known in the art. One needed paintbrush-cleaning tool is a wire brush that includes multiple rows and columns of wire strands or bristles arranged in bundles or clusters. A second needed tool is known as a blunt-edged scraper. It typically is attached to the reverse side of the above-mentioned wire brush tool. A third tool has a single row of sturdy metal teeth in the shape of a comb.

None of these three tools can effectively clean a paintbrush if used alone or with any one of the other two. A clean paintbrush results only when all three tools are used. Most painters use only one of the tools and some use two, but few use all three due to the amount of time involved. Accordingly, most paintbrushes are discarded because their bristles become so heavily caked that no amount of cleaning will be successful.

What is needed, then, is a tool that effectively cleans a paintbrush so that its life can be extended. The professional owner of such a tool would purchase fewer paintbrushes per year, thus reducing the cost of doing business as a painter. Moreover, the productivity of the owner would increase because a brush could be thoroughly cleaned in the time it takes to use just one of the known paintbrush cleaning tools.

The non-professional or homeowner could improve their painting experience by using better quality paintbrushes if they had an effective means of cleaning, conditioning and preserving them after usage. The non-professional user has a tendency to dispose of paintbrushes after each use. Therefore, such users tend to purchase lower quality paintbrushes to save money. The bristles of lower quality paintbrushes often break away during use and may become lodged in a freshly painted surface. This reduces the quality of the work and increases the amount of time spent on the job by the non-professional painter.

Thus there is also a need for a paintbrush cleaning tool that encourages non-professional painters to purchase higher quality paintbrushes.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a tool that effectively cleans paintbrushes in reduced time is now met by a new, useful, and non-obvious invention.

The novel tool for cleaning paintbrushes includes a base, a plurality of bundles of wire strands secured to the base in upstanding relation thereto, at least one scraper blade secured to the base in upstanding relation thereto, and a plurality of comb teeth secured to the base in upstanding relation thereto. Paintbrush bristles are therefore cleaned in three ways by the novel tool.

In a preferred embodiment, the plurality of bundles of wire strands is arrayed on the base in rows and columns. The rows are equidistantly spaced from one another as are the columns. However, such equidistant spacing is not required.

The tool has a longitudinal axis of symmetry. The scraper blade or blades are transversely disposed relative to the longitudinal axis of symmetry in longitudinally spaced apart relation to one another.

In the preferred embodiment, at least one column of the wire strands is disposed between contiguous scraper blades and the scraper blades are disposed in equidistantly spaced relation to one another.

The tool further includes a plurality of comb teeth secured to the base. In the preferred embodiment, the comb teeth are arrayed relative to the base in a plurality of rows and columns. The rows are preferably equidistantly spaced relative to one another as are the columns.

The plurality of comb teeth is preferably disposed in longitudinally spaced apart relation to the wire strands and the scraper blades. More particularly, the plurality of comb teeth is disposed between the wire strands and the handle and between the scraper blades and the handle.

The novel tool thus provides the advantage of three important paintbrush cleaning tools in one tool, and the closely related advantage of reducing the time to clean a paintbrush by one-third.

These and other advantages will become apparent as this disclosure proceeds. The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
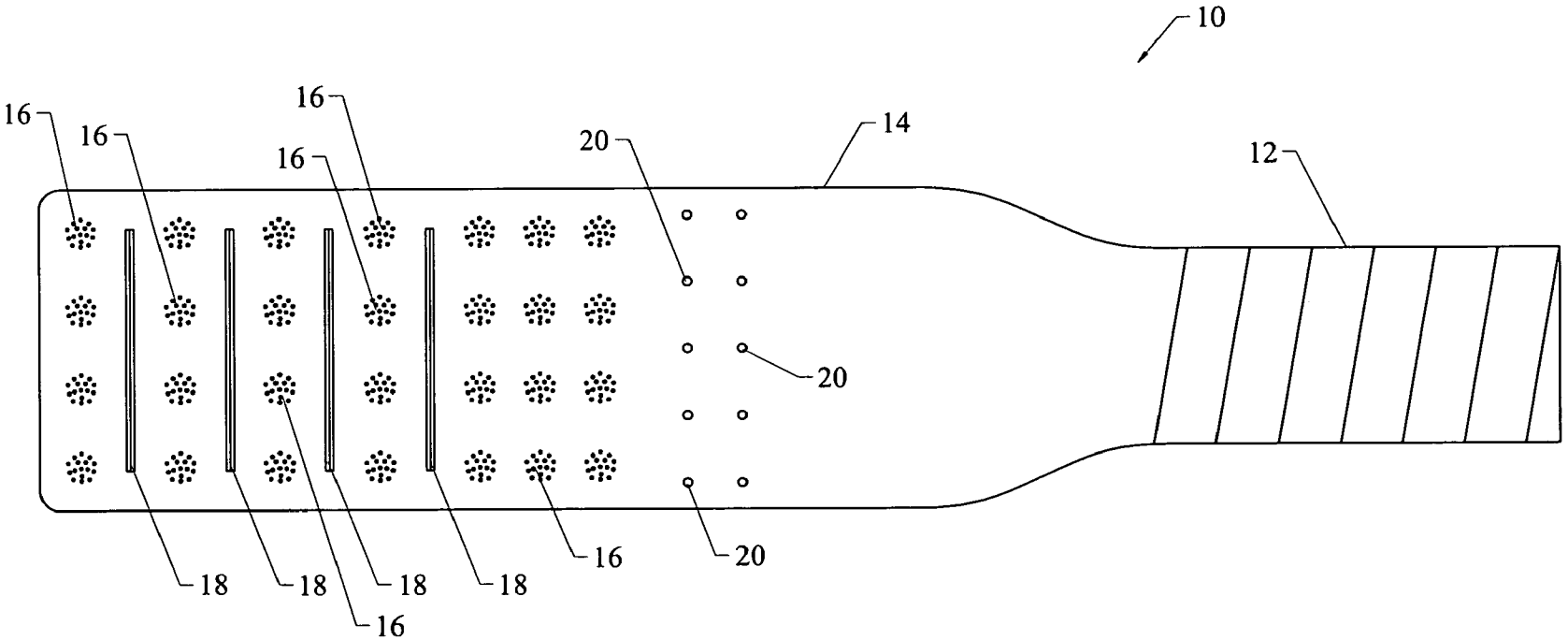
FIG. 1 is a top plan view of the novel tool.
Figure 2:
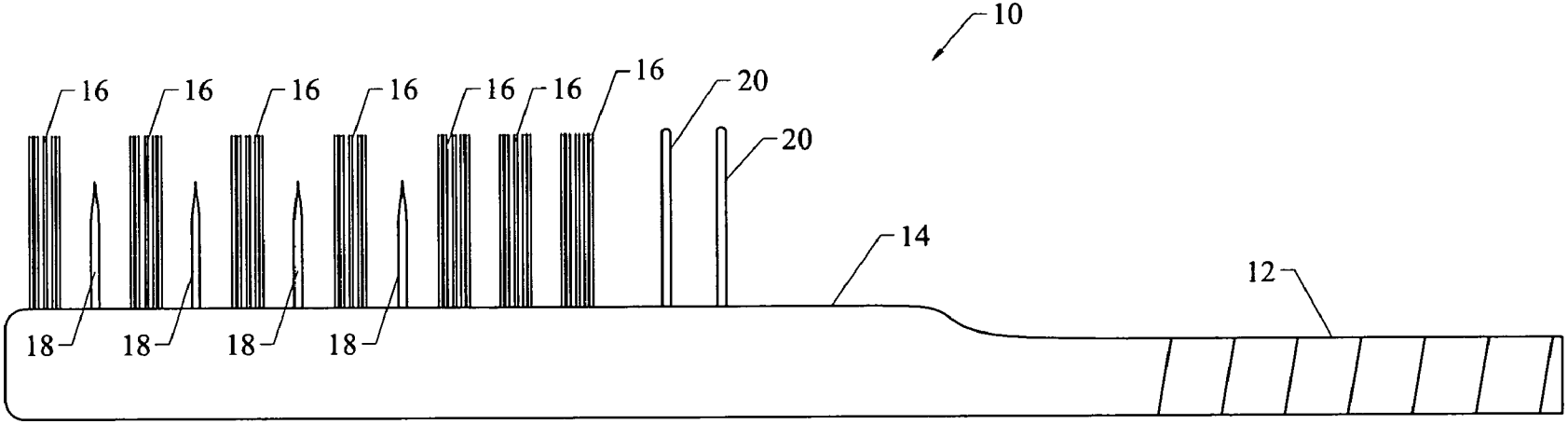
FIG. 2 is a side elevational view thereof.

Referring now to FIGS. 1 and 2, it will there be seen that an illustrative embodiment of the invention is denoted as a whole by the reference numeral 10.

Novel cleaning tool 10 includes handle 12 and base 14 that share a common longitudinal axis of symmetry and which are preferably formed integrally with one another.

A plurality of bundles of wire strands, collectively denoted 16, is secured to base 14 in rows and columns as depicted. In this particular embodiment, there are four rows of said bundles of wire strands and about seven columns but such number of rows and columns is not critical and other numbers are within the scope of this invention.

Each bundle includes a plurality of individual wire strands but the number of strands in each bundle is not critical. Moreover, each row of bundles is depicted as being equidistantly spaced from its contiguous row of bundles, and such equidistant spacing is preferred but it is not critical. Similarly, each column of bundles is depicted as being equidistantly spaced from its contiguous column of bundles, and such equidistant spacing is preferred but it is not critical.

A plurality of blunt-edged scraper blades is collectively denoted 18. Each individual scraper blade is a flat piece of metal or other suitable substantially rigid material. Each scraper blade is disposed transverse to the longitudinal axis of tool 10 and is preferably equidistantly spaced from its contiguous scraper blade. In the preferred embodiment, each blunt-edged scraper blade 18 is separated from its contiguous blunt-edged scraper blade by a column of wire strands 16. In an alternate embodiment, scraper blades 18 could be separated from one another by more than one column of wire strands 16. In another alternate embodiment, scraper blades 18 could be longitudinally spaced apart from one another and there could be no column of wire strands between one or more pairs of contiguous scraper blades. In yet another embodiment, only one scraper blade is employed.

A plurality of comb teeth is collectively denoted 20. In the preferred embodiment, comb teeth 20 are arrayed in columns and rows but they are not intermixed with wire strands 16 and scraper blades 18. However, in an alternate embodiment, comb teeth 20 could be intermixed with said wire strands 16 and scraper blades 18.

With all three of the prior art tools thus combined into a single tool, a paintbrush may be thoroughly cleaned in the same time formerly required to complete only one-third of the cleaning procedure. This increases the productivity of the painter and reduces the number of paintbrushes that must be purchased each month or year.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A tool for cleaning paint brushes, comprising:

a base having a longitudinal axis of symmetry;

a plurality of bundles of wire strands secured to said base in upstanding relation thereto and being arrayed on said base in rows and columns, said rows being equidistantly spaced from one another and said columns being equidistantly spaced from one another;

a plurality of scraper blades secured to said base in upstanding relation thereto and being transversely disposed relative to said longitudinal axis of symmetry of said base;

a plurality of comb teeth secured to said base in upstanding relation thereto; and at least one column of said wire strands being disposed between contiguous scraper blades of said plurality of scraper blades;

whereby paintbrush bristles are cleaned in three ways by said tool.

2. The tool of claim 1, further comprising:

said scraper blades of said plurality of scraper blades being disposed in equidistantly spaced relation to one another.

3. The tool of claim 1, further comprising:

said comb teeth being arrayed relative to said base in a plurality of rows and columns.

4. The tool of claim 3, further comprising:

said rows of comb teeth being disposed in equidistantly spaced relation to one another; and said columns of comb teeth being disposed in equidistantly spaced relation to one another.

5. The tool of claim 1, further comprising:

said plurality of comb teeth being disposed in longitudinally spaced apart relation to said wire strands and said scraper blades of said plurality of scraper blades.

6. The tool of claim 5, further comprising:

said tool including a handle formed integrally with said base, said handle having A longitudinal axis of symmetry in common with the longitudinal axis of symmetry of said base; and said plurality of comb teeth being disposed between said wire strands and said handle and between said scraper blades of said plurality of scraper blades and said handle.

* * * * *